United States Patent [19]

Young

[11] 4,019,031

[45] Apr. 19, 1977

[54] REGISTER PRICE WHEEL STRUCTURE

[75] Inventor: Einar T. Young, Newtown Square, Pa.

[73] Assignee: Sun Oil Company of Pennsylvania, Philadelphia, Pa.

[22] Filed: July 10, 1975

[21] Appl. No.: 594,935

Related U.S. Application Data

[62] Division of Ser. No. 489,275, July 17, 1974, Pat. No. 3,920,964.

[52] U.S. Cl. ..... 235/131 FD; 235/94 R; 235/144 D

[51] Int. Cl.[2] ..... G06C 15/42; G06C 25/00

[58] Field of Search ..... 235/94 R, 94 A, 131 R, 235/131 FD, 131 M, 131 JA, 144 D

[56] References Cited

UNITED STATES PATENTS

| | | | |
|---|---|---|---|
| 1,798,941 | 3/1931 | Helgeby | 235/131 FD |
| 2,331,884 | 10/1943 | Bliss | 235/131 FD |
| 2,645,425 | 7/1953 | Bliss | 235/94 R X |
| 2,814,444 | 11/1957 | Bliss | 235/94 R |
| 3,001,705 | 9/1961 | Fuglister | 235/131 FD |
| 3,164,322 | 1/1965 | Wright et al. | 235/94 R X |
| 3,545,649 | 12/1970 | Hummel et al. | 235/144 D X |
| 3,727,833 | 4/1973 | Müller | 235/94 R X |
| 3,836,072 | 9/1974 | Kelch et al. | 235/94 R X |
| 3,906,206 | 9/1975 | Smilgys | 235/144 D X |

*Primary Examiner*—Stanley J. Witkowski
*Attorney, Agent, or Firm*—J. Edward Hess; Donald R. Johnson; William C. Roch

[57] ABSTRACT

In order to increase the "sale" or "cost" registering capacity of a standard, conventional three-wheel register (counter) used in gasoline dispeners, a modified price wheel has been developed as a substitute for the lowest-order price wheel of a conventional register. This new wheel carries indicia from zero to 99 and during counting makes one revolution for every one hundred cents' worth of gasoline dispensed. The new wheel has an antibacklash arrangement for eliminating inaccuracies during the counting mode, and has an improved reset stop and a linkage mechanism associated therewith, for providing accurate resetting and for preventing improper operation during the resetting mode.

4 Claims, 9 Drawing Figures

REGISTER PRICE WHEEL STRUCTURE

This application is a divisional patent application of application Ser. No. 489,275, filed July 17, 1974 for Register Price Wheel Structure and now U.S. Pat. No. 3,920,964.

This invention relates to mechanically-driven counters, of the type illustrated, for example, in Bliss U.S. Pat. No. 2,814,444. Counters of this type are in common use at the present time in gasoline dispensers (gasoline dispensing apparatus). Most counters presently in use in gasoline dispensers have three wheels each for "sale" or "cost" and gallons, as described in the aforementioned patent. Since each of these wheels is provided about its periphery with indicia consisting of the numerals zero to 9 inclusive, the maximum "sale" capacity of these counters is $9.99, which is presently becoming inadequate.

A three-wheel counter (register) could be replaced by a four-wheel counter (which latter has a "cost" capacity of $99.99), but this would entail a large cost (involving the cost of the new register itself, the necessary new "pump" face, etc., plus the labor cost of the actual replacement); the total cost of this changeover would be extremely large, considering the very large number of three-wheel counters presently in use.

Therefore, an object of the present invention is to provide a novel means for increasing the capacity of a mechanically-driven counter, which is readily applicable to presently-existing counters.

Another object is to provide an arrangement for increasing the capacity of a mechanically-driven counter, without increasing the number of wheels in the counter.

A further object is to provide a novel price wheel structure for registers.

A still further object is to provide a register price wheel which can be used as a replacement wheel, in order to increase the capacity of the register.

Yet another object is to accomplish the foregoing objects in a relatively inexpensive manner.

A detailed description of the invention follows, taken in conjunction with the accompanying drawings, wherein.

Figure 1:
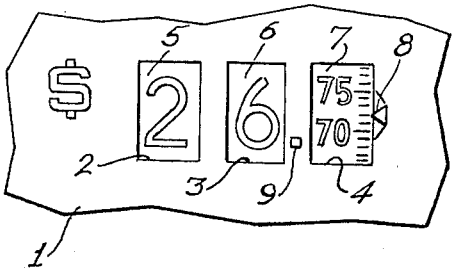
FIG. 1 is a partial view of the face of a gasoline dispensing apparatus, illustrating a cost wheel arrangement utilizing this invention.

Refer first to FIG. 1. The assembled register, as installed in a gasoline dispensing apparatus, is preferably provided with a protective cover 1 which is a generally boxlike housing having three windows 2, 3, and 4 situated in registry with the cost wheels 5, 6, and 7 respectively so as to expose the reading line thereof to view, a fixed index marker or pointer 8 being positioned adjacent the lowestorder cost wheel 7, in the conventional manner.

The two higher-order cost wheels 5 and 6 are each provided about their peripheries with indicia consisting of the numerals 0 to 9 inclusive, in the conventional manner, and these two wheels preferably are constructed as disclosed in the aforementioned patent.

However, according to this invention, the cost wheel 7 of lowest order is provided about its periphery with one hundred graduations (from 00 to 99 inclusive), and with the appropriate numerals adjacent each fifth graduation. This lowest order wheel may therefore be termed a "100 cent" wheel, and is arranged to indicate, on the one wheel, the total number of cents of the sale, from 0 to 99. Thus, the total capacity of the three wheels 5, 6 and 7 is $99.99, with the dollars wheels 5 and 6 indicating individual dollars digits (0 to 9), and the single wheel 7 indicating both digits for the cents. A fixed decimal point 9 is painted on the cover 1 between the wheel 6 and the wheel 7. The lowest order cost wheel 7 is of novel construction, and it is the construction of this wheel which is the essence of the present invention.

Figure 2:
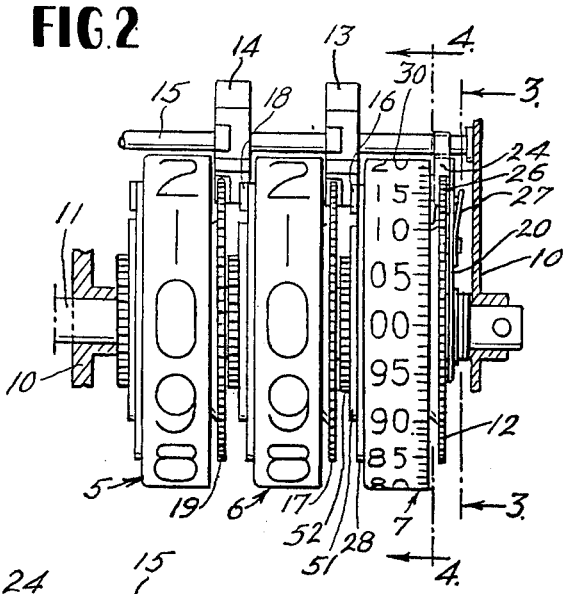
FIG. 2 is a view similar to FIG. 1, but with the pump face removed, illustrating a cost wheel arrangement embodying this invention.

Refer now to FIG. 2, which shows a set of cost wheels 5, 6, and 7 forming a part of a register of the type particularly adapted for use in gasoline dispensing apparatus. The register or counter is mounted on a frame consisting of side plates 10 held apart by suitable spreader bars (not shown). The frame has slidably journaled therein a plurality (usually four) of axially movable but non-rotatable horizontal wheel-supporting shafts, one of which is illustrated at 11. Shaft 11 has mounted thereon the set of rotatable number wheels 5, 6, and 7 for registering the cost of the gasoline dispensed. Of the other three axially movable wheel-supporting shafts referred to, one carries a set of rotatable number wheels corresponding to the wheels 5–7 but mounted at the opposite end of the register (so that the operator or customer may read the indication from either side of the dispensing apparatus); a second shaft carries a set of rotatable number wheels which are utilized to register the quantity of the gasoline dispensed; a third shaft carries a duplicate set of quantity wheels mounted at the end of the register opposite to the previously-mentioned quantity wheels.

A counting gear 12, which is rotatably mounted on shaft 11, is connected or coupled, for the register counting mode, to the lowest-order cost wheel 7 in a manner to be more particularly described hereinafter. During the register counting mode (i.e., during the dispensing cycle), gear 12 is driven through suitable gearing (not shown) from a gear (not shown) mounted on the output shaft of a variator (also not shown) which is set in accordance with the price per gallon of the liquid being dispensed. The arrangement is such that the lowest-order cost wheel 7 is driven from the variator at a speed commensurate with the price of the quantity of gasoline being dispensed, and at a speed such that this wheel makes one revolution for every 100 cent or $1.00 worth of gasoline dispensed. The arrangement just referred to, for driving the cost wheel 7 of lowest order during the counting mode, is preferably quite similar to that disclosed in the aforementioned patent. However, it should be pointed out that the gearing utilized in this invention differs in overall gear ratio as compared to that of the patent, since in the present invention the lowest-order cost wheel 7 makes one revolution for every 100 cent worth of gasoline dispensed, while in the patent arrangement the lowest-order cost wheel makes one revolution for every 10 cent worth of gasoline dispensed; that is to say, the cost wheel 7 rotates at one-tenth the speed of the lowest-order cost wheel in the patented arrangement.

It is the intention that for each complete revolution of a number wheel of lower order, the wheel of next higher order will be rotated one-tenth revolution. The transfer mechanism for transferring the count from the wheels of lower order to the wheels of higher order is somewhat conventional and includes, for the wheels 5–7, the use of transfer pinions 13 and 14 rotatably mounted on a transverse shaft 15 which is fixed to the frame 10, pinion 13 being located between wheels 7 and 6 and pinion 14 being located between wheels 6 and 5. Upon each rotation of the wheel 7 of lowest order, the transfer pinion 13 is engaged by a two-toothed driving gear 16 on wheel 7, which operates to impart a partial rotation to such transfer pinion. Transfer pinion 13 meshes with the counting gear 17 of the number wheel 6 of next higher order, thus advancing the number wheel 6 one-tenth revolution each time the transfer pinion 13 is actuated. Similarly, upon each rotation of the wheel 6, the transfer pinion 14 is engaged by a two-toothed driving gear 18 on wheel 6, which operates to impart a partial rotation to such transfer pinion. Transfer pinion 14 meshes with the counting gear 19 of the number wheel 5 of next higher order, thus advancing the number wheel 5 one-tenth revolution each time the transfer pinion 14 is actuated. The transfer mechanism described is very similar to that disclosed in the aforementioned patent.

One end of a mounting arm 20 is fastened to a bushing 21 which is mounted rotatably with respect to the counting gear 12 but is maintained in a plane substantially parallel to the plane of this gear, between the gear face and a ring 22 which is swaged to the hub 23 of wheel 7. At its opposite end, arm 20 is fixedly secured to a wheel bracket 24 having therein a U-shaped notch 25 which fits around the fixed shaft 15, thereby to keep the bracket 24 and arm 20 fixed in position as the counting gear 12 and number wheel 7 rotate. A pair of friction buttons 26, made preferably of nylon, which extend freely through respective holes in arm 20, are adapted to frictionally engage (at their inner ends) the outer face of gear 12, thereby to provide a continuous frictional force or drag against this gear as the latter rotates. This friction brake arrangement serves as an anti-backlash device, preventing movement of gear 12 when the force driving the same is removed. One end of a leaf spring 27 is fixedly secured to arm 20, and the free end of this spring engages the outer ends of the buttons 26, thereby to urge the latter against gear 12 with a predetermined spring force. This predetermined force governs the frictional force or drag of buttons 26 against the face of gear 12.

Figure 4:
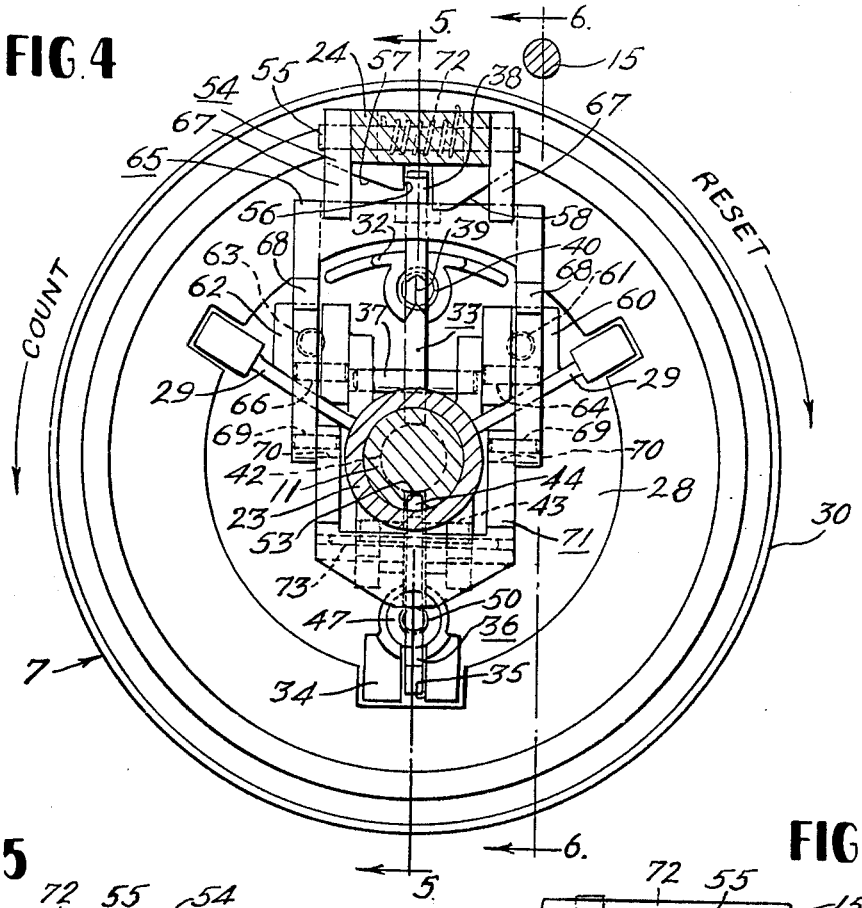
FIG. 4 is a cross-sectiion taken on line 4—4 of FIG. 2.
Figure 5:
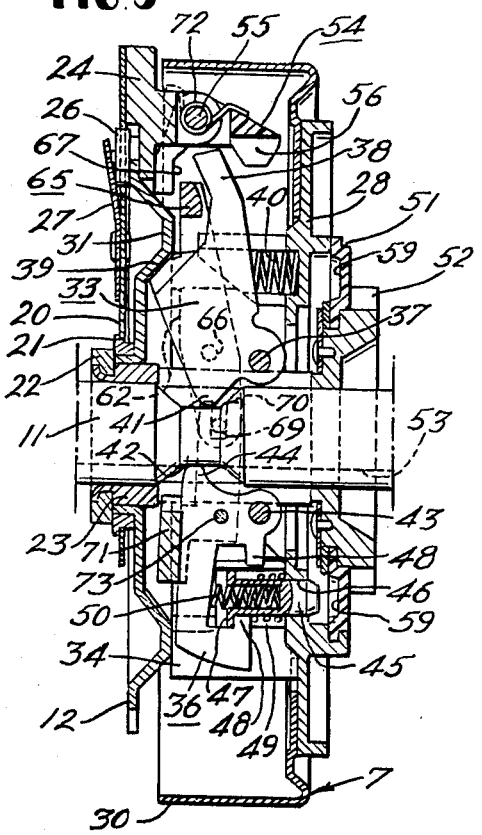
FIG. 5 is a cross-section taken on line 5—5 of FIG. 4, showing the moving parts in the position which they assume during the counting mode of the register.
Figure 6:
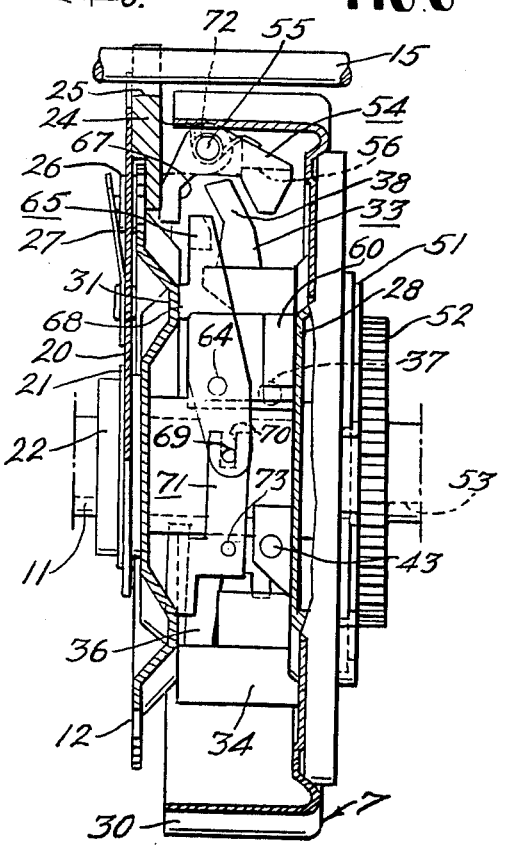
FIG. 6 is a section taken on line 6—6 of FIG. 4, again showing the parts during the counting mode.

The internal construction of the number wheel 7 is best shown in FIGS. 4–6. Referring to these figures, it will be seen that wheel 7 has a hub 23 in which is formed a throughbore for accommodating the wheel-supporting shaft 11, the hub being rotatable and slidable relative to the shaft. Hub 23 is provided with a side wall 28 and radiating webs 29 on which is mounted a cylindrical rim 30 bearing the numerals and graduations hereinbefore referred to. The outer portion of the side wall 28 is integrally formed with the driving gear 16 previously referred to for cooperation with the transfer pinion 13.

Mounted on the hub 23 opposite to the side wall 28 is the counting gear 12 which is freely rotatable on the hub, although it is held in place axially by means of the ring 22. The counting gear 12 is formed with an inwardly-projecting annular ridge 31 in which is formed a frusto-conical band of fine V-shaped serrations or teeth (not shown). One web 32 of the wheel 7 is slotted for accommodating a pivoted driving pawl 33, and a radially opposite web 34 is slotted as indicated at 35 for accommodating a pivoted resetting pawl 36.

Dealing first with the pivoted driving pawl 33, it will be noted that it is in the form of a flat piece pivoted at one end, as by means of a pin 37, to the hub 23, for swinging movement in a radial plane which includes the longitudinal axis of the wheel. The free or outer end of the pawl comprises a tail 38 which will be referred to further hereinafter. Intermediate its ends, this pawl is provided with a knife-edge 39 which is adapted to enter into and engage one of the notches in the V-shaped teeth on counting gear 12. The pawl is normally urged into cooperative engagement with a notch of the counting gear 12 by a compression spring 40 extending between the pawl and the side wall 28.

Figure 7:
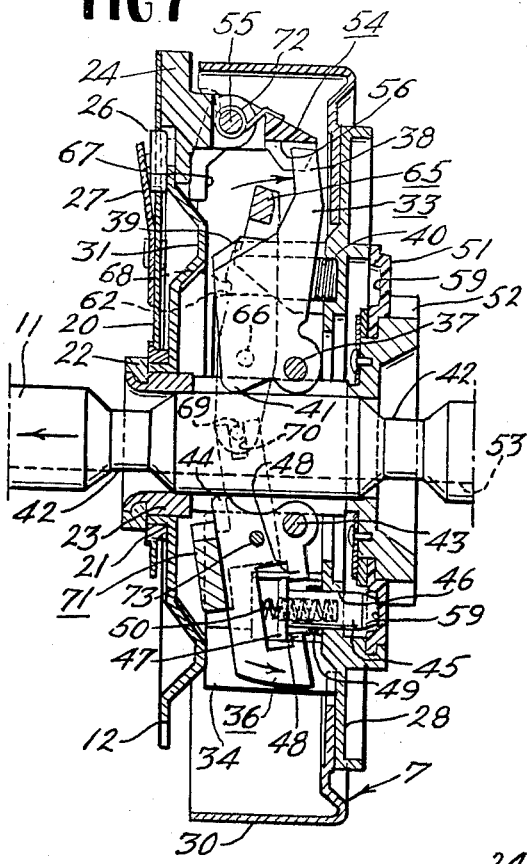
FIG. 7 is a view generally similar to FIG. 5, but showing the moving parts in the position which they assume during the reset mode of the register.

The pawl 33 has adjacent its pivoted end a lobe or projection 41 adapted to extend into the bore of the hub 23 for engagement with the supporting shaft 11. The supporting shaft 11 is provided with a series of circumferential grooves 42 (one for each of the wheels 5, 6, and 7; one of these is shown in FIG. 5) which freely accommodates lobe 41 when the shaft 11 is in registering or counting position as shown in FIG. 5, the supporting shaft being axially shiftable as previously mentioned. When the supporting shaft 11 is in the position shown in FIG. 5 (groove 42 in registry with lobe 41) so that no pivoting force is applied to the lobe 41 of the pawl by the supporting shaft, the pawl is engaged with the teeth of the counting gear 12, so that a positive driving engagement is obtained between this driven gear and the wheel. When the supporting shaft 11 is shifted to the left, as illustrated in FIG. 7 of the drawings, the lobe 41 of the pawl rides up on the periphery of the shaft, thus pivoting the pawl 33 and disengaging its knife-edge 39 from the driven gear 12, thus freeing the wheel 7 from its driving gear 12 and conditioning the wheel for a resetting operation.

Turning now to the pivoted resetting pawl 36, it will be seen that the pawl 36 is generally similar to the pawl 33 in that it also is formed of a flat piece pivoted at one end, as by means of a pin 43, to the hub 23, for swinging movement in a radial plane which includes the longitudinal axis of the wheel. The pawl 36, however, is made somewhat thinner than the pawl 33 for the reason to be more fully explained hereinafter. Like the pawl 33, pawl 36 has a lobe or projection 44 adjacent its pivoted end which also extends into the bore of the hub 23 for engagement with the supporting shaft 11 or circumferential groove 42, depending on the shifted position of the supporting shaft.

Pawl 36 has associated therewith a plunger 45 which is axially slidable in a bore 46 in the side wall 28. The inner end of the plunger 45 has a head 47 which is embraced by the finger-like projections 48 of the pawl 36. The pawl 36 is urged in a clockwise direction as viewed in FIGS. 5 and 7 by reason of a spring 49 extending between the side wall 28 and the pawl, and surrounding the plunger 45. The plunger is urged outwardly of the wheel relative to the pawl by means of a spring 50 between the plunger 45 and pawl 36. As a result of this construction, the pawl 36 is normally urged in a clockwise direction so that, when its lobe or projection 44 is received in the circumferential groove 42, it will draw in the plunger 45 (see FIG. 5). Conversely, when the pawl is shifted in a counterclockwise direction by shifting of the supporting shaft 11, the plunger 45 is free to move outwardly under the influence of spring 50 (see FIG. 7).

Rotatably mounted on the outer side of the side wall 28 is a disc 51 having fixed thereto a gear 52. The disc 51 is rotatably supported on the side wall 28 and is retained axially by means of a plurality of integral overhanging members which engage and hold the disc 51. The disc 51 is provided on its inner face with a plurality of holes 59 which are circularly arranged at a distance from the axis of the wheel such that they may be brought into registry with the plunger 45 which, as previously mentioned, is asociated with the pawl 36. The result is that when the wheel supporting shaft 11 is shifted axially to pivot the pawl 36 in a counterclockwise direction (see FIG. 7), the wheel may be picked up and rotated by rotating the gear 52. In the event one of the holes in the disc 51 is not lined up with the plunger 45 when the pawl 36 is pivoted counterclockwise, the plunger 45 will not move, but instead will merely further compress the spring 50. However, as soon as any rotation is applied to the disc 51 by rotating the gear 52, one of the disc holes will quickly be brought into registry with the plunger 45, and the spring 50 will move the plunger outwardly into engagement therewith.

As previously mentioned, the supporting shaft 11 during a resetting operation is in the shifted position shown in FIG. 7, so as to disengage the number wheel 7 from the driven gear (counting gear) 12 and so as to permit the wheel to be picked up by its associated disc 51 upon rotation of the resetting gear 52, whereupon the wheel may be returned to zero position (in the clockwise or "Reset" direction, as viewed in FIG. 4) upon continued rotation of the gear 52. There is a longitudinal slot 53 in the supporting shaft 11, this slot being sufficiently wide and deep to accommodate the lobe 44 of the pawl 36 when the pawl is substantially in radial alignment therewith. As will be appreciated, as soon as the lobe 44 of the pawl 36 actually falls into the slot 53, the pawl immediately withdraws its associated plunger 45 from the disc 51, thus interrupting any further resetting movement of the number wheel 7, even though further additional turning movement may be applied to the associated gear 52 and hence the disc 51.

The pawl 33, being thicker than the pawl 36, will ride over and not engage in the longitudinal slot 53, and thus will not interfere with the resetting operation.

Figure 3:
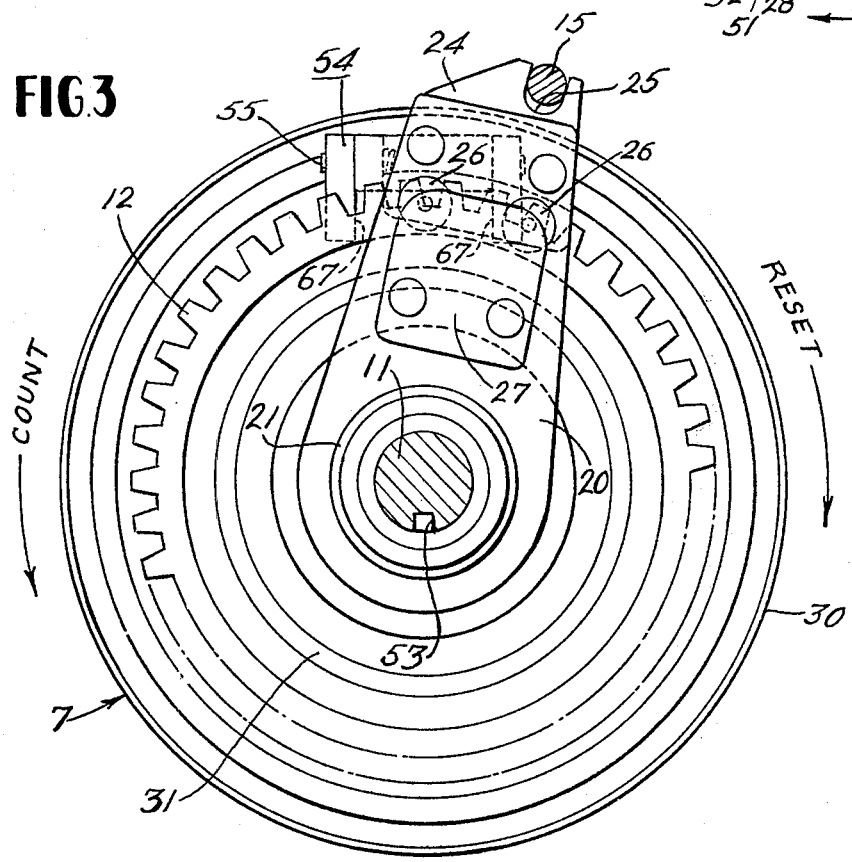
FIG. 3 is a sectional view taken on line 3—3 of FIG. 2.

As described hereinabove, when the supporting shaft 11 is in the shifted (resetting) position illustrated in FIG. 7, the number wheel 7 is disengaged or decoupled from the driven or counting gear 12, and is coupled to the resetting gear 52, by way of disc 51, plunger 45, and pawl 36. During the register resetting mode which follows, the resetting gear 52 is preferably driven by a conventional spring-powered pawl-and-plate mechanism (not shown) which may be, for example, constructed and arranged as disclosed in the aforementioned patent, and particularly in FIGS. 12–15 of said patent. As described in such patent, each disc such as 51 is rotated by its resetting gear such as 52 at least one turn, and preferably one turn plus a fraction, to ensure that all of the wheels in the register will be picked up and returned to zero position. The "Reset" direction for number wheel 7 (during the resetting mode, when disc 51 is coupled to the wheel and counting gear 12 is uncoupled therefrom) is clockwise as viewed in FIGS. 3 and 4. The "Count" direction for this wheel (during the counting mode, when disc 51 is uncoupled from the wheel and counting gear 12 is coupled thereto) is counterclockwise as viewed in FIGS. 3 and 4.

It is absolutely essential, in a register of the type hereinbefore referred to, that the number wheels be reset accurately to zero, which is to say that when the wheels are stopped during the resetting operation, they must be in exact zero position. On the number wheel 7 of this invention, the indicia (i.e., the adjacent graduations, representing cents) are quite close together. For example, a typical cylindrical rim 30 may have a circumference of 10 inches, and since there are one hundred graduations on the circumference, adjacent graduations are 1/10 inch apart. In the register described in the aforementioned patent, the number wheels were stopped, during the resetting mode, as soon as the wheels were rotated to the position wherein the lobes of the resetting pawls (the lobe denoted by numeral 44 herein) fell into the shaft slot (the slot denoted by numeral 53 herein). However, due to manufacturing tolerances and wear in the pawl lobe and slot, and due also to the fact that this stopping means is located at such a small radial distance from the center of shaft 11, this reset stopping means is not sufficiently accurate for the number wheel 7 of this invention (taking into account the close spacing of the graduations on such wheel). Therefore, according to this invention a novel reset stopping means is provided for the lowest-order cost wheel 7, and such means will now be described.

A reset detent denoted generally by numeral 54 and made of a hard, long-wearing material such as nylon, is pivotally mounted by means of a pin 55 on the fixed wheel bracket 24, on the inner side thereof, opposite the arm 20. From FIG. 4, it may be seen that this detent 54 is located just radially inside the cylindrical rim 30 of the wheel. Pin 55 is fixed in a pair of integral, spaced, parallel outstanding ears (not specifically referred to) on bracket 24. The reset detent 54, mounted on its fixed pivot pin 55, is adapted to swing in a radial plane, counterclockwise from its rest position as viewed in FIG. 5. Detent 54 is biased toward its "normal" or rest position. (FIGS. 5 and 7) by means of a torsion spring 72 which surrounds pin 55; one end of this spring engages the detent 54 and the other end engages fixed bracket 24.

Viewed in cross-section as in FIG. 5, the detent 54 is of somewhat inverted U-shape. Speaking in this sense, the "inner leg of the U" comprises a central slot 56 (which is adapted to receive therein, at certain times, the tail 38 of the driving pawl 33; see FIG. 4) bounded respectively by two beveled portions 57 and 58 (beveled toward the center of the wheel). In the counting mode, the pivoted driving pawl 33 is so oriented that its tail 38 is located in an axial plane between the two "legs of the U" of detent 54; thus, the detent 54 does not interfere with the rotation of pawl 33 during the counting mode (see FIG. 5).

However, when the shaft 11 is shifted to move the parts to the reset mode (see FIG. 7), the tail 38 of the driving pawl 33 is swung into an axial plane such that it can cooperate with the "inner leg of the U", and the latter can then serve as a detent for the driving pawl 33 and, hence, for the number wheel 7. The beveled portion 58 of the reset detent 54 extends further radially inwardly, toward the center of shaft 11, than does the other beveled portion 57.

When the resetting mode first begins, the driving pawl 33 will in general (though not always, as will be described hereinafter) be at some angular position away from the fixed reset detent 54. The driving pawl 33 rotates with the number wheel 7 during resetting (as well as during the counting mode). When the tail 38 of pawl 33 comes into engagement with the beveled portion 57 of detent 54, this detent is pushed aside (causing counterclockwise pivoting, viewed in FIG. 7, of this detent) to permit the tail of the pawl to enter slot 56 from the left side thereof (viewed in FIG. 4). The wall of beveled portion 58 bounding slot 56 serves as a stop for the pawl tail, the action thus causing the pawl tail 38 to snap into and remain in slot 56. The action described (when the tail 38 of pawl 33 enters and is stopped in the detent slot 56, in which position it is shown in FIG. 4) results in the positive stopping of the number wheel 7, even though the disc 51 may continue to rotate.

The fixed detent slot 56 in reset detent 54 is accurately positioned in relation to the pawl 33 (and to the number wheel 7) so that, when the tail 38 of this pawl engages in the slot, the wheel will be in exact zero position. The location of this slot at a radial distance from the center of the wheel which is large as compared to the radius of shaft 11 enhances the accuracy of positioning of the wheel at zero.

When the number wheel reaches the immediate vicinity of its zero position, lobe 44 of the resetting pawl 36 falls into shaft slot 53, thus interrupting further resetting movement of the number wheel 7 (by withdrawal of plunger 45 for disc 51, as previously described). Even though this may occur slightly before the number wheel reaches its exact zero position, there is sufficient inertia in the resetting mechanism to carry the wheel to its exact zero position (which latter is determined by the pawl tail 38 entering detent slot 56, as previously described).

With the construction so far described, the number wheel 7 may not reset properly under certain conditions. This may come about by reason of the following. To prevent resetting errors, the number wheel must be reset to zero from positions close to zero (i.e., 99 cent, or 1 cent), as well as from all other positions. When the number wheel 7 stops at 99 cent, or at 1 cent, the lobe 44 of resetting pawl 36 would be substantially aligned with shaft slot 53, and would tend to fall thereinto. This is because of wear and manufacturing tolerances of the pawl and slot, and also taking into account the fact that the individual graduations on the rim 30 are only 1/10 inch apart, for example, and this rim has a radius from the center of the wheel (actually, from the center of the shaft 11) which is large compared to the radius at which the shaft slot 53 is located. As previously described, when pawl 36 falls into slot 53, the resetting gear 52 is disconnected or decoupled from number wheel 7, so that if this should occur when the number wheel stops at 1 cent, or at 99 cent, no resetting to zero could take place.

According to this invention, a linkage mechanism, now to be described, comes into play when the wheel stops at 99 cent, or at 1 cent, to prevent this decoupling from taking place, thus assuring proper resetting to zero of the wheel.

Figure 8:
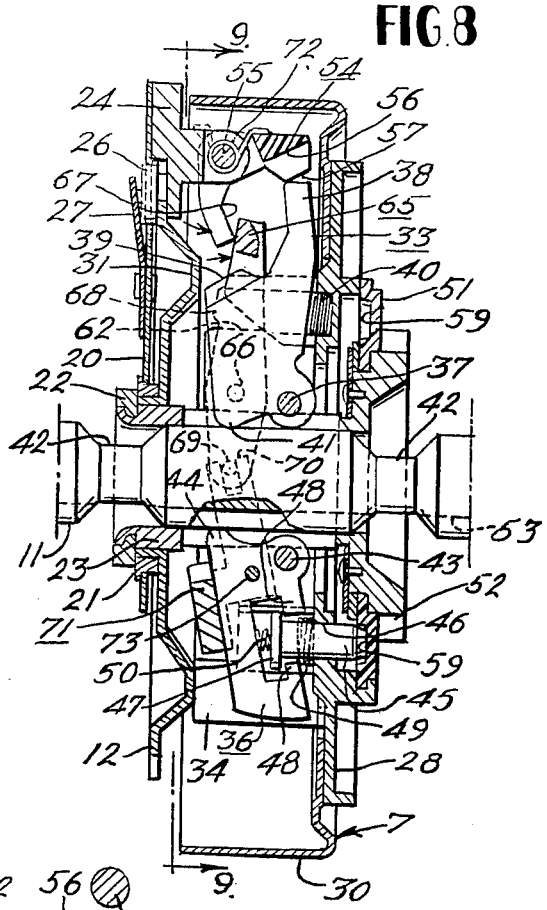
FIG. 8 is a view similar to FIG. 7, but showing the moving parts in the position which they assume when resetting the lowest-order cost wheel from a "1" position to a zero position.
Figure 9:
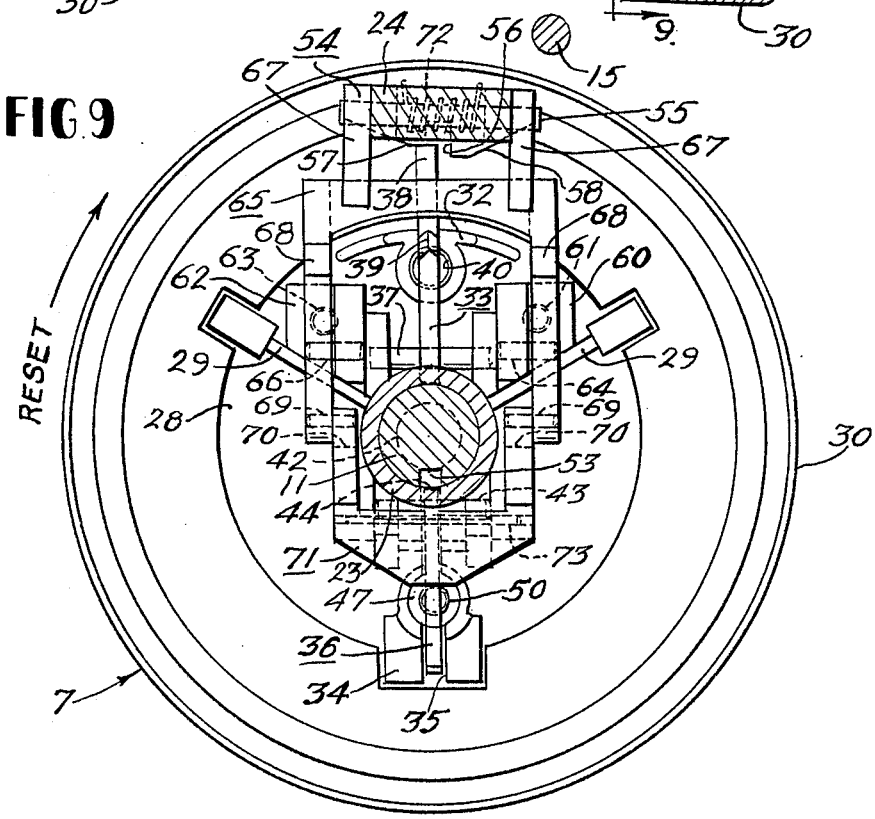
FIG. 9 is a cross-section taken on line 9—9 of FIG. 8.

Refer now more particularly to FIGS. 8 and 9. An L-shaped bracket 60 is mounted in the corner formed between one end of pin 37 (which pivots driving pawl 33) and one web 29, one leg of this bracket being secured to side wall 28 by means of a screw which threads into a tapped hole 61 in the bracket. A similar L-shaped bracket 62 is mounted in the corner formed between the opposite end of pin 37 and the other web 29, one leg of bracket 62 being secured to side wall 28 by means of a screw which threads into a tapped hole 63 in this bracket.

The upstanding leg of bracket 60 pivotally carries, as by means of a pin 64, one leg of a U-bar 65 (which is U-shaped in front elevation, as seen in FIGS. 4 and 9) the base of which is located radially outwardly beyond web 32. The upstanding leg of bracket 62 pivotally carries, as by means of a pin 66, the other leg of U-bar 65. The fixed pivot pins 64 and 66 are both located at points intermediate the ends of the respective legs of U-bar 65.

The "outer leg of the U" of detent 54 (viewed in cross-section as in FIGS. 5–8) comprises a pair of depending integral legs 67 which are adapted, upon counterclockwise rotation (viewed as in FIG. 8) of detent 54 from its "rest" position of FIG. 5, to engage the base of U-bar 65 (as illustrated in FIG. 8), on the side thereof which faces counting gear 12. (How this rotation of detent 54 is brought about will be described hereinafter).

The described rotation of detent 54 causes U-bar 65 to swing about its pivots 64 and 66, in the clockwise direction as viewed in FIGS. 5 and 8, from its rest position of FIG. 5 to the position illustrated in FIG. 8.

As illustrated in FIG. 6, each of the legs of U-bar 65 has, intermediate is ends, a raised pad 68 of a rather small area (⅛ inch by ⅛ inch, for example), which contacts the inner surface of ridge 31 of counting gear 12 to limit the movement of U-bar 65 in the counterclockwise direction.

A pin 69 is fixedly secured to the outer end of each respective leg of the U-bar 65, and these pins are pivotally engageable in respective bifurcations 70 formed in the ends of each of the two legs of a U-shaped pawl actuator 71 (U-shaped in front elevation, as seen in FIGS. 4 and 9). The two legs of actuator 71 span the hub 23 of the number wheel, as do also the two legs of the U-bar 65 (though the U-bar legs are spaced further outwardly from the hub than are the actuator legs); the base of actuator 71 is located just radially outwardly of hub 23. As may be seen particularly in FIGS. 5 and 7, the base of actuator member 71 extends over that edge of resetting pawl 36 which faces the counting gear 12.

The base of actuator member 71 is pinned (i.e., fixedly secured) to the resetting pawl 36, as by a pin 73 which is press-fitted into holes provided in the actuator member and in the pawl. This rigid pinned connection is at the end of actuator member 71 opposite to the bifurcated arm couplings 70.

When U-bar 65 is caused to swing about its pivots 64 and 66 in the clockwise direction (as described previously, in connection with FIG. 8), actuator member 71, which is pivotally coupled to the U-bar at 69, 70 and is rigidly connected at 73 to the resetting pawl 36, causes said pawl to pivot about its pin 73 in the counterclockwise direction as viewed in FIG. 8. This rotational force acting on pawl 36 prevents the pawl lobe 44 from moving clockwise into the shaft slot 53, even though the pawl may then be aligned therewith, as illustrated in FIG. 9. Also, of course, since this counterclockwise pivotal movement of pawl 36 is equivalent to that produced by the shaft-shifting operation (for resetting) described in connection with FIG. 7, the plunger 45 moves outwardly to couple the resetting disc 51 (and gear 52) to the number wheel 7.

Summarizing the foregoing, the counterclockwise rotation of detent 54 illustrated in FIG. 8 causes, by means of the linkage 65, 71, a shifting of the pawl 36 in a counterclockwise direction, with a resultant engagement of the plunger 45 with the resetting disc 51. Thus, under these conditions the number wheel 7 remains coupled to the resetting gear 52, even though the pawl 36 is then aligned with the shaft slot 53 (which alignment, absent the aforementioned linkage, would result in the pawl dropping into the shaft slot, with a consequent decoupling or uncoupling of the number wheel from the resetting disc 51 and gear 52).

FIGS. 8 and 9 illustrate the positions of the parts at the beginning of a resetting operation, when the number wheel 7 has stopped counting at its 1 cent position. Under these conditions, the tail 38 of the driving pawl 33 is not aligned with the slot 56 of detent 54 (since the number wheel is then not at its zero position), even though the resetting pawl 36 may be aligned with shaft slot 53 (see FIG. 9). Now, when the shaft 11 is shifted (as in FIG. 7) to place the number wheel in the resetting mode, driving pawl 33 pivots as usual, but now tail 38 of this pawl comes into engagement with beveled portion 57 of detent 54 to pivot this detent counterclockwise as shown in FIG. 8. This counterclockwise rotation of the reset detent results in shifting the pawl 36 in a counterclockwise direction by means of the linkage 65, 71, engaging plunger 45 with resetting disc 51 as previously described, and thus coupling the number wheel 7 to the resetting gear 51 so that this wheel can properly reset to zero (by clockwise rotation of the wheel in FIG. 9, as indicated, and as previously described, until the pawl tail 38 enters slot 56 of the detent 54). Entry of pawl tail 38 into detent slot 56 stops the number wheel at its zero position, as described previously, and when the pawl tail enters slot 56 detent 54 returns to the "rest" position of FIG. 7, releasing the linkage 65, 71 so that lobe 44 of pawl 36 is then free to fall into shaft slot 54 to decouple the number wheel 7 from the resetting disc 51 and gear 52.

An operation similar to that just described takes place at the beginning of a resetting operation when the number wheel 7 has stopped counting at its 99 cent position. Under these latter conditions, the pawl tail 38 is not aligned with the slot 56 of detent 54 (since the number wheel is then not at its zero position), even though the resetting pawl 36 may be aligned with shaft slot 53 (similar to the showing in FIG. 9). Now, when the shaft 11 is shifted (as in FIG. 7) to place the number wheel in the resettig mode, driving pawl 33 pivots as usual, but now tail 38 of this pawl comes into engagement with beveled portion 58 of detent 54 to again pivot this detent counterclockwise from its "rest" position. This counterclockwise rotation of the reset detent, from its rest position, again results in shifting the pawl 36 in a counterclockwise direction by means of the linkage 65, 71, engaging plunger 45 with resetting disc 51 as previously described, and thus coupling the number wheel 7 to the resetting gear 52 so that this wheel can be properly reset to zero (by clockwise rotation of the wheel as indicated in FIG. 4, and as previously described, until the pawl tail 38 enters slot 56 of the detent 54). Entry of pawl tail 38 into detent slot 56 stops the number wheel at its zero position, as described previously, and when the pawl tail is in this slot the linkage 65, 71 is released so that lobe 44 of pawl 36 is free to fall into shaft slot 54 to decouple the number wheel 7 from the resetting disc 51 and gear 52.

It should now be apparent that, according to this invention, counting errors (which might otherwise arise as a result of backlash in the counting gear train) are overcome by the use of the friction braking arrangement 26, 27, which provides a constant frictional force or drag against the counting gear 12.

Also, the fixed reset detent 54, located near the radially-outer edge of the number wheel 7, cooperates with the tail 38 of the driving pawl 33 to provide an accurate reset stop (at the zero position) for the number wheel.

In addition, the mechanical linkage 65, 71, prevents inappropriate uncoupling of the number wheel from the resetting disc 51 (when resetting is from the 1 cent or 99 cent position of the number wheel 7), thus assuring proper resetting of the number wheel.

Although the invention has been described in relation to price wheels, and to the lowest order of a set, it is to be understood that the invention may also be used for other number wheels, e.g. quantity wheel, and for higher order wheels of a set.

The invention claimed is:

1. In a counter, a supporting shaft, a number wheel rotatably mounted on the shaft, a driven gear for rotating the number wheel during a counting operation, and means for applying a frictional force against said gear and including an arm mounted on and supported by said shaft adjacent to said driven gear, and a leaf spring secured to said arm and being biased against said driven gear to exert a substantially constant drag upon said gear as the latter rotates.

2. A counter as set forth in claim 1 and wherein said counter includes a second shaft coupled to said arm for preventing rotation of said arm around said supporting shaft.

3. A counter as set forth in claim 1 and including a pair of friction buttons mounted on said leaf spring and adapted to directly contact said gear.

4. A counter as set forth in claim 3 and wherein said counter includes a second shaft coupled to said arm for preventing rotation of said arm around said supporting shaft.

* * * * *